US009077125B2

(12) United States Patent
Hogan

(10) Patent No.: US 9,077,125 B2
(45) Date of Patent: Jul. 7, 2015

(54) HIGH SPEED NETWORK CABLE TRANSCEIVER CONNECTOR

(71) Applicant: Lenovo Enterprise Solutions (Singapore) Pte. Ltd., Singapore (SG)

(72) Inventor: Michael W. J. Hogan, Kanata (CA)

(73) Assignee: Lenovo Enterprise Solutions (Singapore) Pte. Ltd., Singapore (SG)

( * ) Notice: Subject to any disclaimer, the term of this patent is extended or adjusted under 35 U.S.C. 154(b) by 79 days.

(21) Appl. No.: 13/895,442

(22) Filed: May 16, 2013

(65) Prior Publication Data

US 2014/0342580 A1 Nov. 20, 2014

(51) Int. Cl.

| | |
|---|---|
| ***H01R 12/00*** | (2006.01) |
| ***H01R 12/72*** | (2011.01) |
| ***H01R 12/71*** | (2011.01) |
| *H01R 12/79* | (2011.01) |

(52) U.S. Cl.

CPC ..... *H01R 12/724* (2013.01); *Y10T 29/49147* (2015.01); *H01R 12/712* (2013.01); *H01R 12/79* (2013.01)

(58) Field of Classification Search

CPC ..... H01R 23/7073
USPC ..... 439/79, 502
See application file for complete search history.

(56) References Cited

U.S. PATENT DOCUMENTS

| | | | | |
|---|---|---|---|---|
| 6,098,127 | A * | 8/2000 | Kwang | 710/62 |
| 8,223,498 | B2 | 7/2012 | Lima | |
| 2012/0058670 | A1 | 3/2012 | Regnier et al. | |
| 2012/0099275 | A1 | 4/2012 | Regnier | |
| 2012/0257355 | A1 | 10/2012 | Yi et al. | |

OTHER PUBLICATIONS

Anonymous, "Installing a Transreceiver in a QFX Series Device," Technical Documentation, Juniper Networks, Inc., Sep. 14, 2012, 2 pgs.

Anonymous, "Quad Small Form-factor Pluggable Plus (QSFP+) Interconnect Solution," www.molex.com/product/qsfp+.html, 2011, 14 pgs.

(Continued)

*Primary Examiner* — Phuong Dinh
(74) *Attorney, Agent, or Firm* — Zilka-Kotab, PC

(57) ABSTRACT

A device connects a computer network cable transceiver to a printed circuit board. The device includes a high-profile connector body that mounts to a printed circuit board. The height of the device above the printed circuit board is greater than the width of the device on the printed circuit board. The device has a receiving element that receives and electrically connects the network cable transceiver to an electrical connection element. The rotated aspect of this device controls the profile of the network cable transceiver that is inserted into the device. The electrical connection element is mechanically and electrically attached to the printed circuit board to enable data transfer to and from the network cable transceiver. Some embodiments of the invention have a variable-length electrical communication element that permits the electrical connection element to mount to the printed circuit board in a variety of positions and orientations rather than the fixed position and orientation of a low-profile network cable connector.

17 Claims, 4 Drawing Sheets

(56) References Cited

OTHER PUBLICATIONS

Anonymous, "SFF-8436 Specification for QSFB+ 10 Gbs 4x Pluggable Transreceiver," Rev. 4.4, Oct. 26, 2012, ftp://ftp.seagate.com/sff, Oct. 26, 2012, 86 pgs., (date accessed: Nov. 21, 2012; date printed: Jan. 9, 2013).

Anonymous, "Siemon QSFP+ Passive Copper Assemblies," www.siemon.com/SIS, Siemon Interconnect Solutions, SS-SIS-QSFP_CU Rev. D 9/11, 2011, 2 pgs., (date accessed: Nov. 21, 2012; date printed: Jan. 9, 2013).

* cited by examiner

HIGH SPEED NETWORK CABLE TRANSCEIVER CONNECTOR

FIELD OF THE INVENTION

This disclosure relates generally to computer hardware design, and more specifically to the design of connectors for computer network cable transceivers.

BACKGROUND

High performance computer networking involves the coordinated transmission and receipt of large quantities of data. Specialized cabling, transceivers, and connectors are constantly developed to accommodate greater data transmission rates. Power consumption typically increases with higher transmission rates and heat dissipation from networking equipment becomes more important.

SUMMARY

Disclosed herein are embodiments of a connector device. The connector device connects a computer network cable transceiver to a printed circuit board. The connector has a connector body with a front side characterized by two lengths, a first length and a second length. The first length is measured across the front side from where the connector body is positioned on the printed circuit board and substantially perpendicular to a mounting surface of the printed circuit board. The second length is measured perpendicular to the first length. The first length is longer than the second length. The front side of the connector body has a receiving element that is adapted to mechanically and electrically connect with a computer network cable transceiver. An electrical communication element makes an electrical connection with the network cable transceiver inside the receiving element. The electrical communication element also makes an electrical connection with an electrical connection element of the connector. The electrical connection element is adapted to mechanically and electrically connect to the printed circuit board and to complete the electrical connection between the circuit board and the computer network cable transceiver.

Disclosed herein are methods of using embodiments of a connector device. One method mounts a connector on a printed circuit board by providing a connector body with a front side that has a first length and a second length measured across the front side. The first length is measured substantially perpendicular to a mounting surface and the second length is measured perpendicular to the first length. The first length is longer than the second length. A receiving element is located on the front side of the connector body. The receiving element is adapted to mechanically and electrically connect to a computer network cable transceiver. The connector has an electrical communication element that mechanically and electrically connects with the receiving element and with an electrical connection element. The electrical connection element is adapted to mechanically and electrically connect to the printed circuit board and mounted on the printed circuit board.

Disclosed herein are methods of using embodiments of a connector device. One method enables electrical communication with a printed circuit board. A connector body with a front side is attached to a mounting surface on a printed circuit board. The connector body has a front side characterized by two lengths. A first length is measured substantially perpendicular to the mounting surface of the printed circuit board, and a second length is measured perpendicular to the first length. The first length is longer than the second length. A receiving element on the front side of the connector body is connected to an electrical communication element. The electrical communication element is electrically connected to an electrical connection element. The electrical connection element is mechanically and electrically connected to the printed circuit board. The receiving element is adapted to mechanically and electrically connect to a computer network cable transceiver. A computer network cable transceiver is inserted into the receiving element and electrically connected to the printed circuit board through the electrical communication element and the electrical connection point.

DETAILED DESCRIPTION

Figure 1A:
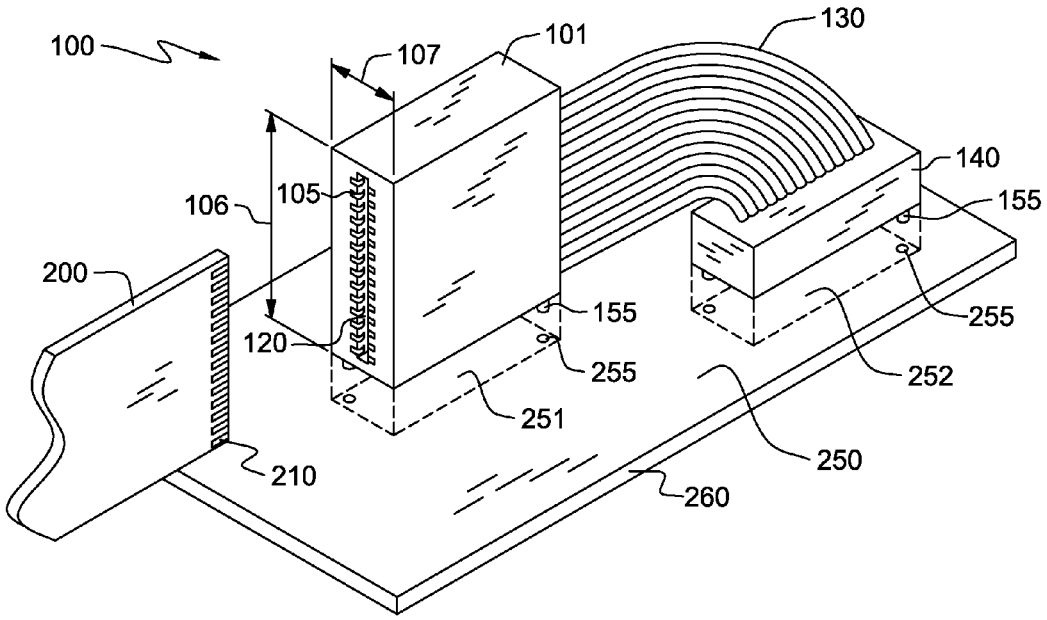
FIG. 1A illustrates an example embodiment of a high-profile network cable transceiver connector mounted to a printed circuit board.

Among the complexities of managing large-scale computer networks, two issues predominate: space constraints and power/heat management. These issues appear at multiple levels in the computer network: system-wide, within the individual networked device, and at the level of individual network board elements. In order to control costs, network administrators seek to use a minimum amount of networking hardware because excess or underutilized networking hardware in the system merely adds to the system's operational cost. Network connections will be densely, rather than sparsely, populated in order to use rackspace and networking hardware most efficiently. This pursuit of efficiency carries over into the power/heat domain when network administrators cap power consumption and heat production by limiting the amount of hardware in the computer network. Because a network is no better than the sum of its components, decisions made at the level of circuit board connectors or individual devices "trickle up" to influence the total efficiency, size, and speed of a computer network.

Various types of networking cables, connectors, and networking protocols have been developed in order to optimize fast, reliable data transmission over a computer network while dealing with space and heat issues. Networking requirements in server farms, data centers, internet data transmission backbones, and high performance computing installations all benefit from more efficient space and power usage. These types of facilities are where benefits from networking improvements will be most apparent.

Networking performance generally improves when the network can transmit more data or when the data can move more quickly. Capacity and speed improvements may occur when by creating more connections between networked devices, by using faster individual connections, or by performing data compression prior to transmitting information in order transmit data more efficiently over existing network connections.

Compressing data prior to transmission, followed by decompression at the receiving networked device, is sometimes an effective method of improving network performance if the particular data compresses to a significant degree and the total cycle time/energy cost of the compression—transmission—decompression process is significantly more efficient than standard data transmission. But because data compression efficiency is difficult to predict, however, other means of network performance improvements are generally preferred.

Total network performance can be increased by creating more connections between networked devices or by increasing the maximum connection transmission speed while keeping the total number of connections constant. Currently, single high-speed networking channels can carry data at rates of tens gigabits per second (10 Gb/s). By doubling the number of connections between two networked devices, a network administrator can create a stepwise increase in the network capacity between devices, nearly doubling the relevant carrying capacity. This additional capacity comes, however, at the expense of using an additional network connector on each device and with additional heat production from the data transceivers to which the devices are connected. Increasing the maximum data transmission rate over a single network connection is more efficient with regard to both space constraints and energy consumption than merely adding more connections between networked devices. Although increases in maximum data transmission rates are relatively infrequent because they require considerable hardware development and widespread agreement on designs and new operation protocols, they are preferentially adopted because of their greater efficiency relative to a multiple-connections solution.

High speed network connectors typically have a low-profile shape (i.e., their width measured parallel to the circuit board where they are mounted is greater than their height perpendicular to the circuit board). A low profile provides for easy and rapid connector manufacture and installation and allows for secure transceiver fastening, but tends to reduce the total number of network connectors that can be mounted on a single printed circuit board. Faceplate area on the end of a networked device places a hard limit on the number of connectors that can be attached to a single circuit board and still accessed through the faceplate.

While some networked devices may include multiple closely-spaced networking cards, each of which may have several network cable connectors, the majority of networking devices restrict their designs to rows of elongated network cable connectors along the plane of the circuit board to which they are attached, taking up a maximal amount of space along the circuit board for each connector. Some designs increase the total number of network connectors in a single device by mounting rows of connectors on both sides (top and bottom) of the circuit board. Other networking devices employ stacked clusters of two, four, or more network connectors on the circuit board in order to pack connectors more densely. Both of these scenarios employ network connectors with the longest dimension across the connector aligned parallel with the circuit board. While these dual-side or stacked-cluster connector arrangements are improvements with regard to efficient use of space, they pose additional challenges with regard to cooling close-packed network cable transceivers during operation.

The electronics that transform the transmitted signal into a processor- or storage-compatible format is called a transceiver. The transceiver combines the transmitting and receiving functions into a single piece of hardware. As data transmission rates increase the transceiver must operate faster to generate and receive the stream of data sent over the computer network.

When a network cable transceiver connects to a printed circuit board, a high speed networking connector is first placed on and mounted to a printed circuit board. After the connector is attached, a transceiver cage placed over the connector is itself attached to the board. The transceiver cage, a four-sided housing, guides a networking cable transceiver to the connector, aligns the end of the transceiver with the connector opening, and ensures that the transceiver fits into the connector opening when further inserted into the cage/housing. When the transceiver is inserted into the connector, it makes an electrical contact through the connector to the circuit board.

As data transmission speeds have increased the transceivers operate at higher frequencies and they produce greater amounts of heat. While the total energy use and heat production increases with higher transceiver frequencies, the low-profile form factor remains roughly the same size, making heat dissipation an important issue.

The development of small form-factor high speed networking connectors is outlined below. The small form-factor pluggable (SFP) connector is a common high-speed network connector capable of connecting with either electrical or optical network cable transceivers at gigabit speeds. The next step up in high speed networking uses the Small Form-factor Pluggable Plus (SPF+) low-profile network connector to reach speeds of up to 10 Gb/s Like the SFP connector, the SFP+ connector only connects to a single data transmission cable at a time. SFP+ transceivers are capable of achieving transmission speeds of 10 Gb/s.

A Quad Small Form-factor Pluggable Plus (QSFP+) low-profile network connector operates significantly faster than SPF and SFP+ connector/transceiver designs because it is designed to accommodate four simultaneously-attached electrical or optical data transmission cables and reach total transmission rates of up to 40 Gb/s. Heat dissipation requirements of individual QSFP+ transceiver/connector pairs are more critical because of the combined higher data transmission rate. Without sufficient cooling, elevated operating temperatures lead to premature hardware failure and additional hardware replacement costs.

During normal operation the transceiver and housing get very hot and are cooled by air passing over the transceiver and housing. One solution to the worsening problem of heat dissipation involves modifications to the design of these alignment housings. Some housing designs incorporate cutouts or attached radiative structures to increase heat dissipation rates. Typically, cooling effectiveness increases with greater levels of exposed transceiver surface or larger radiative structures.

Another way to reduce the problem of cooling single or closely-stacked transceivers is to throttle their operational speed in order to reduce the heat they produce. Running a transceiver at some fraction of its full operational speed has the unfortunate effect of reducing total sustained networking performance but does mitigate the problem of excess heat production. When cooling is inadequate for the heat produced during sustained operation at the highest transceiver speeds, throttling the speed may permit adequate cooling at lower sustained operation levels.

The presently disclosed embodiments may improve the cooling ability of a network cable transceiver and increase the number of connections that will fit in the faceplate of a networked device. A high-profile connector design that orients the long axis of a network connector transceiver perpendicular to the circuit board to which the connector is mounted serves not only to place the narrow edge of the connector and transceiver on the circuit board, but also exposes more transceiver body surface to cooling airflow. Because cooling is directly related to exposed surface area, a high-profile connector may have distinct advantages over a low-profile connector. The exposed surface area of a vertically-oriented high-profile QSFP+ transceiver housing, for example, is over 20% greater than for a horizontally-oriented low-profile QSFP+ transceiver housing.

FIG. 1A illustrates an example embodiment of a high-profile network cable transceiver connector 100 and where it may be mounted to a printed circuit board 260. The connector 100 includes a connector body 101, with a front side 105. The front side 105 is characterized by two measurements across the front side 105, a first length 106 and a second length 107. The first length 106 is measured roughly perpendicular to mounting surface 250 on printed circuit board 260 where the connector body 101 may be mounted. The second length 107 is measured perpendicular to the first length 106. The first length 106 is longer than the second length 107, so the connector body 101 can be described as a high-profile body rather than a low-profile body as is typically used in networking applications. The connector body 101 may be positioned on a mounting area 251 on the mounting surface 250, for example by inserting alignment pins 155 into alignment holes 255 within the mounting area 251.

An electrical communication element 130 such as a ribbon cable or bundled array of individual electrical wires may extend from the connector body 101 to an electrical connection element 140. The electrical connection element 140 may also be mounted on the mounting surface 250 of the printed circuit board 260, for example by inserting alignment pins 155 into alignment holes 255 within a separate mounting area 252 on the mounting surface 250. The alignment pins 155 on the electrical connection element 140 may provide structural for the electrical connection element 140 by holding it in place before soldering or after the soldered connection is completed. Inserting a network cable transceiver 200 into the receiving element 120 on a front side 105 of a connector body 101 creates an electrical connection with the printed circuit board 260 through the electrical communication element 130 and the electrical connection element 140.

In FIG. 1A, the electrical connection element 140 is aligned such that a long side of the electrical connection element 140 is parallel to the direction of insertion of a network cable transceiver 200 into the connector body 101. The electrical communication element 130 may be shorter or longer in order to vary the distance between the mounting area 251 for the connector body 101 and the mounting area 252 for the electrical connection element 140 on the printed circuit board 260. The electrical connection element 140 may be oriented over a range of angles relative to the insertion direction of the network cable transceiver 200 and a range of distances from the mounting area 251 for the connector body 101 in order to provide flexibility when designing the printed circuit board 260. The electrical communication element 130 may be made of a ribbon cable or a bundled array of individual wires and may have a range of possible lengths to accommodate printed circuit board 260 layout requirements. If the electrical communication element 130 is flexible, the electrical connection element 140 may be rotated through a range of alignments on the printed circuit board 260 in order to accommodate printed circuit board 260 alignment. The electrical communication element 130 may exit the connector body 101 in a linear pattern or in an array of wire exit points, or in a circular pattern depending on the design of the internal elements of the connector 100.

Figure 1B:
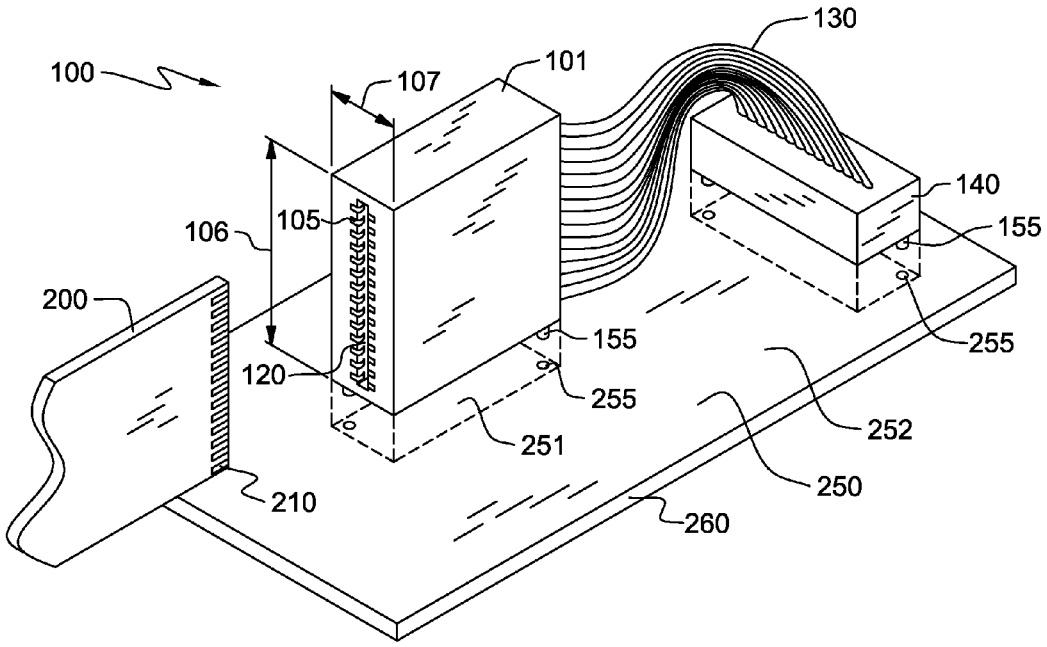
FIG. 1B illustrates an example embodiment of a high-profile network cable transceiver connector mounted to a printed circuit board.

FIG. 1B illustrates an example embodiment of a high-profile network cable transceiver connector 100 and where it may be mounted to a printed circuit board 260. As in FIG. 1A, a connector body 101 with a front side 105 is aligned above a mounting area 251 within a mounting surface 250 on a printed circuit board 260. The front side 105 has a first length 106 and a second length 107. The first length 106 is measured nearly perpendicular to the mounting surface 250 and the second length 107 is measured perpendicular to the first length 106. Because the first length 106 is longer than the second length 107, the connector body may be described as high-profile rather than a low-profile body typically used in networking applications. The connector body 101 may be positioned on the mounting area 251 using alignment pins 155 that are inserted into alignment holes 255 within the mounting area 251.

FIG. 1B further shows an alternative orientation of an electrical connection element 140 part of the connector 100. The electrical connection element 140 may itself be positioned on a mounting area 252 within a mounting surface 250 on a printed circuit board 260, for example by using alignment holes 255 to capture alignment pins 155 and to orient the electrical connection element above the mounting area 251 prior to soldering the electrical connection element 140 to the printed circuit board 260. This example embodiment of the claimed invention orients an elongated electrical connection element 140 such that a long side of the electrical connection element 140 is perpendicular to the insertion direction of a network cable transceiver 200 into the receiving element 120 on the front side 105 of the connector body 101. The electrical connection element 140 may be elongated, or square, or rounded according to the needs of the printed circuit board 260 design. The orientation of the electrical connection element 140 on the printed circuit board 260 is a fluid parameter of printed circuit board 260 design.

Figure 2:
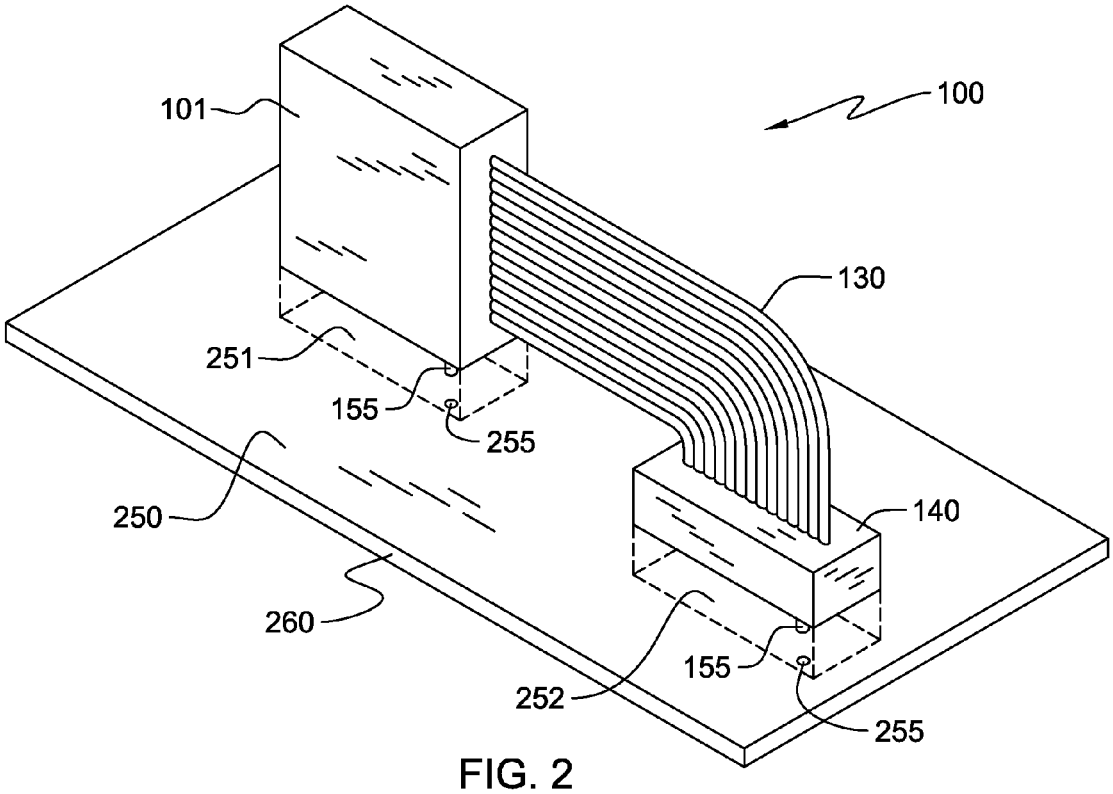
FIG. 2 illustrates an example embodiment of a high-profile network connector with a visible electrical communication element and a separate electrical connection element.

FIG. 2 is a diagram of an embodiment of a high-profile network cable transceiver connector 100 prepared to receive a network cable transceiver 200, the connector 100 having an electrical communication element 130 that carries signals from the transceiver 200 to the electrical connection element 140 mounted on a printed circuit board 260, the connector body 101 oriented to show where the electrical communication element 130 exits the connector body 101. The connector body 101 may be positioned on a mounting area 251 within a mounting surface 250, for example by inserting aligning pins 155 on the connector body 101 into alignment holes 255 inside the mounting area 251 on the printed circuit board 260. The electrical connection element is positioned above a second mounting area 252 on the mounting surface 250 of the printed circuit board 260 and may be aligned and held in place, for example by alignment pins 155 inserted into alignment holes 255 in the printed circuit board 260 within the mounting area 252.

Figure 3:
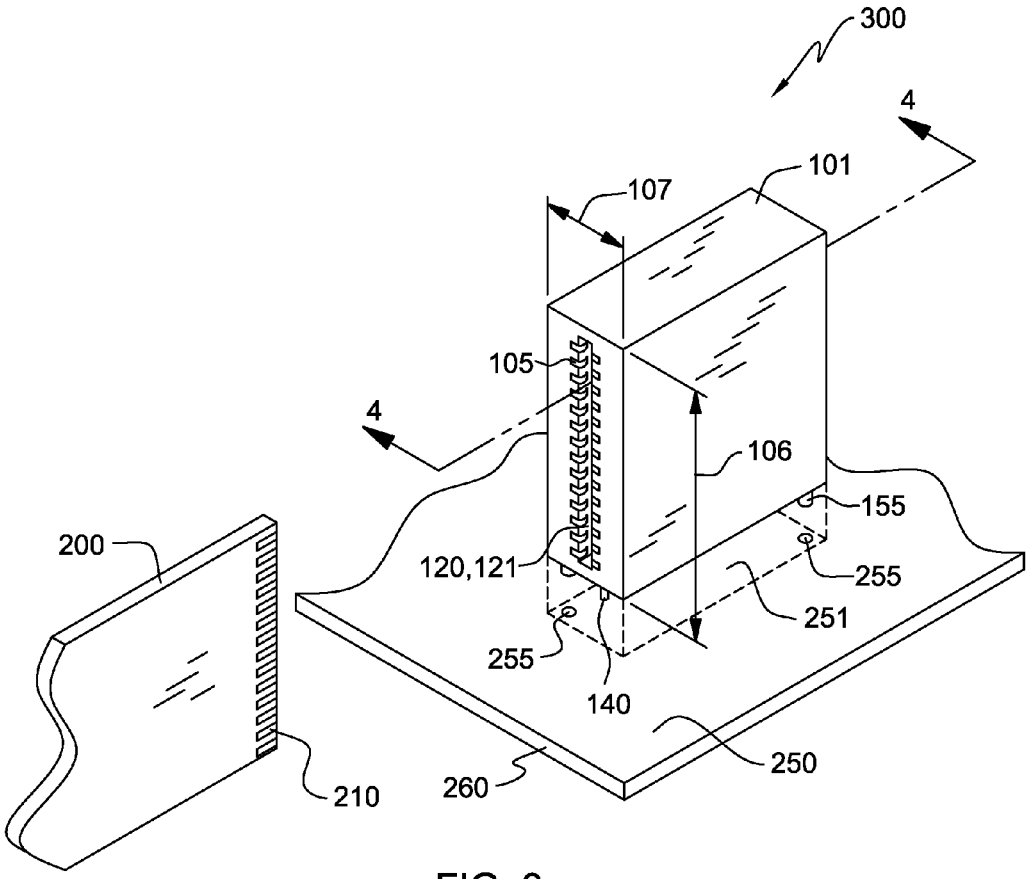
FIG. 3 illustrates an example embodiment of a single-piece network cable transceiver connector mounted on a circuit board.

FIG. 3 is a diagram of an embodiment of a single-piece network cable transceiver connector 300 positioned above a mounting area 251 on a printed circuit board 260. The connector body 101 may be positioned on the mounting area 251, for example by alignment pins 155 on the bottom of the connector body 101 that may be inserted into alignment holes 255 within the mounting area 251. The front side 105 of the connector body 101 is characterized by two perpendicular lengths, a first length 106 measured substantially perpendicular to the mounting surface 250 of the printed circuit board 260 and a second length 107 measured roughly parallel to the mounting surface 250 and substantially perpendicular to the first length 106. FIG. 3 shows an embodiment of the receiving element 120 on the front of the connector body with a rectangular channel 121 adapted to receive a rectangular network cable transceiver 200.

Figure 4:
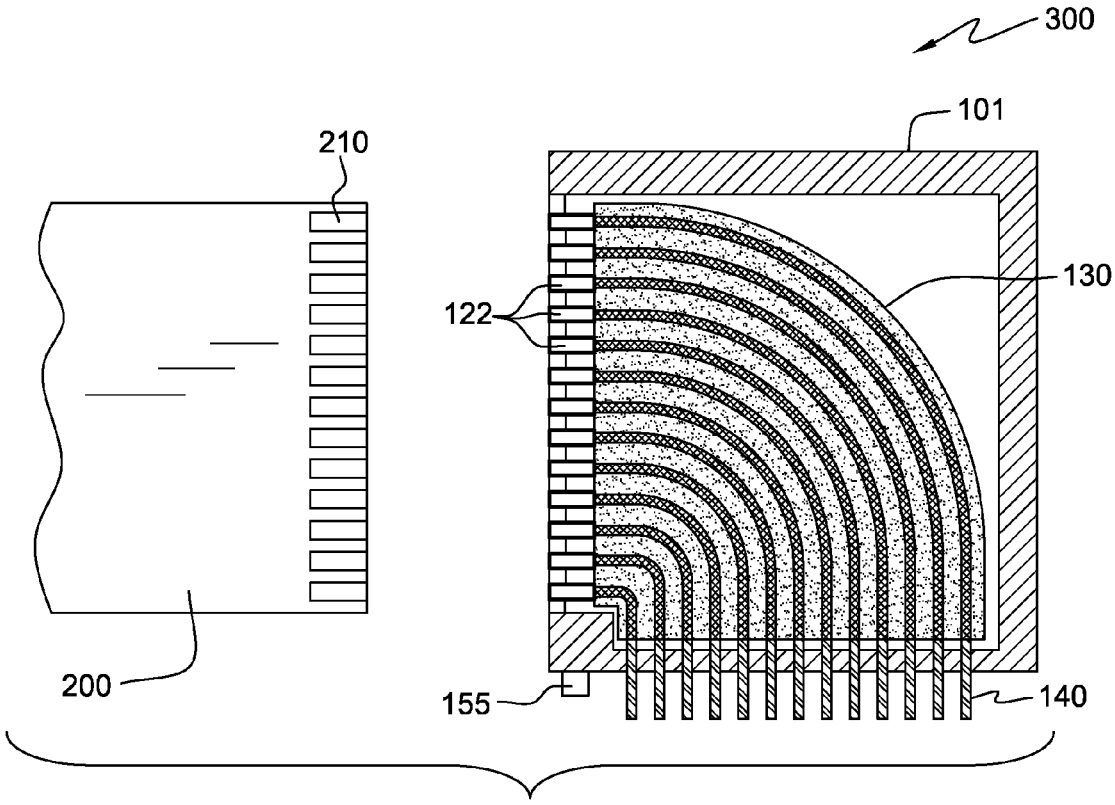
FIG. 4 illustrates an example embodiment of a single-piece high-profile network cable transceiver connector with an internal electrical communication element.

FIG. 4 is a cutaway diagram of an embodiment of a single-piece network cable transceiver connector 300. FIG. 4 shows a pathway for the electrical communication element 130 inside the connector body 101. Electrical contact areas 210 on the network cable transceiver 200 may make physical and electrical contact with the electrical communication element 130 inside the connector body 101. The electrical contact areas 210 may also make electrical contact with, for example, an array of spring-like electrical contact elements 122 that are themselves electrically connected to the electrical connection element 130 within the connector body 101. In this embodiment, the electrical communication element 130 connects to the electrical connection element 140 located at the bottom of the connector body 101. The aligning pins 155 may have a constant circumference along their entire length, or they may have two different circumferences, the larger circumference measured closer to the connector body and the smaller circumference measured farther from the connector body. If an alignment pin has a constant circumference for its entire length, the connector body 101 may sit flush on the mounting surface 250 of the printed circuit board 260. If a mounting pin 155 has a larger circumference portion close to the connector body 101, only the lower portion of the alignment pin 155 may recess into the alignment hole 255, leaving the connector body 101 elevated off the printed circuit board 260.

Figure 5:
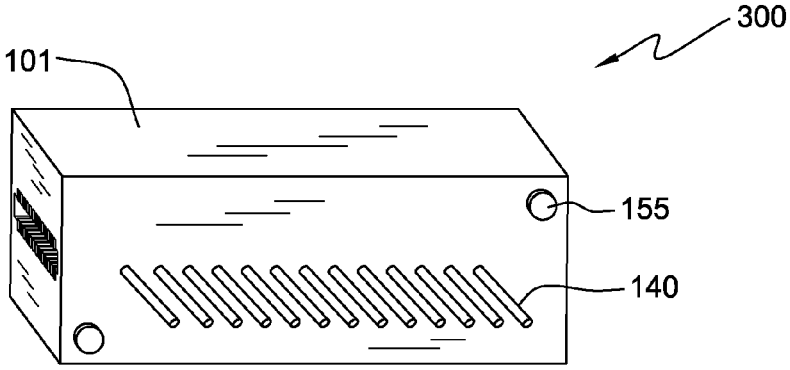
FIG. 5 illustrates an example embodiment of a single-piece high-profile network cable transceiver connection with an electrical connection element to connect to a printed circuit board.

FIG. 5 is a view of a pair of alignment pins 155 and an electrical connection element 140 on a single-piece network cable transceiver connector 300 prior to aligning and mounting the connector body on a printed circuit board. The electrical connection element may extend below the connector body 101 or may be flush with the lower surface of the connector body 101 prior to creating the electrical connection with the circuit board 260.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments herein.

What is claimed is:

1. A device, comprising:

a connector body having a first length measured across a front side and a second length measured across the front side in a direction perpendicular to the first length, the first length being longer than the second length and substantially perpendicular to a plane of a mounting surface on a printed circuit board such that a narrow edge of the connector body defined by the second length is on the printed circuit board;

a receiving element located on the front side of the connector body, the receiving element adapted to mechanically and electrically connect to a computer network cable transceiver;

an electrical communication element connected to the receiving element; and an electrical connection element connected to the electrical communication element, the electrical connection element adapted to electrically and mechanically connect to the mounting surface on the printed circuit board.

2. The device of claim 1, wherein the receiving element is a channel substantially parallel with the first length and wherein the receiving element has an array of electrical connection contacts positioned to make electrical contact with the computer network cable transceiver.

3. The device of claim 1, wherein the receiving element is adapted to mechanically and electrically connect to a QSFP+ network cable transceiver.

4. The device of claim 1, wherein the electrical communication element is a flexible multi-strand electrical cable.

5. The device of claim 1, wherein the connector body is positioned on a first mounting area of the printed circuit board, and wherein the electrical connection element is positioned on a second mounting area of the printed circuit board.

6. The device of claim 1, wherein the device is a single-piece network cable transceiver connector.

7. The device of claim 1, wherein the electrical communication element is a rigid multi-strand electrical connecting element.

8. The device of claim 6, wherein the electrical communication element follows a pathway inside of the connector body such that the electrical communication element connects to the electrical connection element at a bottom surface of the connector body.

9. The device of claim 8, wherein the electrical connection element extends below the connector body at the bottom surface of the connector body.

10. The device of claim 8, wherein the electrical connection element is with the bottom surface of the connector body.

11. A method of connecting a computer network cable transceiver to a printed circuit board, the method comprising:

providing a connector with a connector body having a first length measured across a front side and a second length measured across the front side in a direction perpendicular to the first length, the first length being longer than the second length and substantially perpendicular to a plane of a mounting surface on the printed circuit board such that a narrow edge of the connector body defined by the second length is on the printed circuit board, the connector body further having a receiving element located on the front side of the connector body, the receiving element adapted to mechanically and electrically connect to the computer network cable transceiver;

attaching, electrically, and mechanically, an electrical connection element to the mounting surface on the printed circuit board;

connecting, electrically and mechanically, the receiving element and the electrical connection element using an electrical communication element; and inserting the computer network cable transceiver into the receiving element.

12. The method of claim 11, wherein the electrical communication element is a flexible multi-strand cable.

13. The method of claim 11, wherein the electrical communication element is a rigid multi-strand electrical connecting element.

14. A method of enabling a printed circuit board to electrically communicate with a computer network cable transceiver, the method comprising:

providing a connector with a connector body having a first length measured across a front side and a second length measured across the front side in a direction perpendicular to the first length, the first length being longer than the second length and substantially perpendicular to a plane of a mounting surface on the printed circuit board such that a narrow edge of the connector body defined by the second length is on the printed circuit board; and providing an electrical communication element between a receiving element adapted to mechanically and electrically connect to the computer network cable transceiver, located on the front side of the connector body, and an electrical connection element;

mechanically and electrically attaching the electrical connection element to the printed circuit board; and inserting the computer network cable transceiver into the receiving element.

15. The method of claim 14, wherein the connector body is positioned on a first mounting area of the printed circuit board, and wherein the electrical connection element is positioned on a second mounting area of the printed circuit board.

16. The method of claim 15, wherein the second mounting area is parallel to the first mounting area.

17. The method of claim 15, wherein the second mounting area is perpendicular to the first mounting area.

* * * * *